US009078306B2

(12) United States Patent
Mans et al.

(10) Patent No.: US 9,078,306 B2
(45) Date of Patent: Jul. 7, 2015

(54) LIGHTING CONTROL SYSTEM

(75) Inventors: Paul Mans, Wembley Middlesex (GB); Merlin Milner, Wembley Middlesex (GB)

(73) Assignee: C.P. ELECTRONICS LIMITED, Wembley Middlesex (GB)

( * ) Notice: Subject to any disclaimer, the term of this patent is extended or adjusted under 35 U.S.C. 154(b) by 823 days.

(21) Appl. No.: 13/388,976

(22) PCT Filed: Jun. 18, 2010

(86) PCT No.: PCT/GB2010/051010

§ 371 (c)(1), (2), (4) Date: Apr. 16, 2012

(87) PCT Pub. No.: WO2011/015839

PCT Pub. Date: Feb. 10, 2011

(65) Prior Publication Data

US 2012/0187867 A1 Jul. 26, 2012

(30) Foreign Application Priority Data

Aug. 4, 2009 (GB) ..... 0913556.7

(51) Int. Cl.
*H05B 37/02* (2006.01)

(52) U.S. Cl.
CPC ..... *H05B 37/029* (2013.01)

(58) Field of Classification Search
None
See application file for complete search history.

(56) References Cited

U.S. PATENT DOCUMENTS

| | | | | |
|---|---|---|---|---|
| 6,801,003 | B2 * | 10/2004 | Schanberger et al. | 315/291 |
| 8,305,014 | B1 * | 11/2012 | Li et al. | 315/308 |
| 2002/0195975 | A1 * | 12/2002 | Schanberger et al. | 315/291 |
| 2005/0035728 | A1 * | 2/2005 | Schanberger et al. | 315/291 |
| 2008/0265799 | A1 | 10/2008 | Sibert | |

FOREIGN PATENT DOCUMENTS

| | | |
|---|---|---|
| DE | 3221873 | 6/1982 |
| EP | 2086289 | 8/2009 |
| JP | 2008243390 | 10/2008 |
| WO | WO 97/09869 | 3/1997 |

* cited by examiner

*Primary Examiner* — Long Nguyen
(74) *Attorney, Agent, or Firm* — Thorpe North & Western LLP

(57) ABSTRACT

A lighting control system (1) comprising: a plurality of lights (3); a control unit (2); and a power usage monitor (4) suitable for monitoring the power used by the lights (3). In use, when the user varies the lighting level of a first light, the control unit is configured to vary the lighting level of at least a second light, dependent upon an evaluated total power usage level.

11 Claims, 2 Drawing Sheets

LIGHTING CONTROL SYSTEM

FIELD OF THE INVENTION

This invention relates to the field of lighting control, particularly but not exclusively for use in residential and commercial environments.

BACKGROUND TO THE INVENTION

Existing lighting control systems sometimes use a plurality of preconfigured lighting arrangements, or scenes, to create visual ambience in a built environment. A user can select between different scenes in order to find one which meets their needs and mood at that point in time. Typically, a lighting scene is created by setting a selection of lighting channels or circuits to particular lighting levels and then storing that configuration so that it can be invoked quickly by the user. However scenes have previously been used only to provide an aesthetic lighting effect.

Reducing the energy consumed by a lighting system can help to reduce costs, both in terms of money and in terms of production of carbon dioxide. Therefore, a lighting control system that offers both user control and easy control of energy consumption would be very desirable.

SUMMARY OF THE INVENTION

Accordingly, this invention provides a lighting control system 1 comprising: a plurality of lights 3; a control unit 2; and a power usage monitor 4 suitable for monitoring the power used by the lights 3. In use, when the user varies the lighting level of a first light, the control unit is configured to vary the lighting level of at least a second light, dependent upon an evaluated total power usage level.

The invention further provides a lighting control system comprising: a plurality of lights; a control unit; and a power usage monitor suitable for monitoring the power used by the lights. In a first mode of operation, when the user increases the lighting level of a first light, the control unit is configured to decrease the lighting level of at least a second light such that the total power usage remains beneath a predetermined maximum. Therefore the control unit is configured to decrease the lighting level of one or more other lights or lighting circuits. This may be pre-configured by the user or an algorithm will be used to decrease other lights by the same percentage of output In this way the invention provides a system that offers direct user control and energy efficiency. The user is able to increase the light levels at a given point by increasing the lighting level at that point, and in response the system will decrease lighting elsewhere, where it is typically less needed, and hence conserve energy.

Typically, the user will control the lighting levels using a touch-screen display, usually a liquid crystal display, through which the user can adjust the level of individual lights and change the maximum power usage. Alternatively, the lighting levels and maximum power usage may be controlled using manual controls such as switches, or via a PC running suitable software.

Often, the lighting control system further comprises at least one dimmer, arranged so as to control the power supply to at least one light. By dimming the lights rather than simply switching them on and off, the system and the user can more precisely control the lighting levels and power consumption of the lights.

The power consumption monitor may comprise a power meter for measuring the wattage consumed by the lights. The power meter will typically comprise a volt meter and a current meter such that the power consumption can be calculated from their readings. Alternatively, the power usage monitor may comprise a unit that calculates power consumption based on the current lighting level and the known characteristics of the lighting control system. The power usage monitor may further be the control unit.

It may be that, in a second mode of operation, when the user decreases the lighting level of a first light, the control unit is configured to increase the lighting level of at least a second light such that the total power usage remains above a predetermined minimum.

Typically, in a third mode of operation, there are no predetermined levels of power usage. This third mode of operation allows the user complete control over the lighting levels, in the event that they do not wish to restrain overall energy consumption low.

It may be that, in a fourth mode of operation, when the user changes the lighting level of a first light, the control unit is configured to change the lighting level of at least a second light such that the total power usage remains within a predetermined range. The predetermined range may be a fixed point, such that the system is configured to keep power levels as close to this point, for example a given number of watts, as possible.

It may be that the user is able to adjust the power consumed by the lighting control system centrally, and that the control unit is configure to change the lighting level of the lights such that the total power usage is that determined by the user.

In the presently preferred embodiment, the control unit is configured to store a plurality of scenes, each scene comprising the lighting levels of the plurality of lights, and reproduce a scene in response to actions from the user. Typically each scene is associated with a predetermined maximum power usage. Therefore the invention is a means of having both the aesthetic aspects of a lighting scene and allowing the user to set the power consumption of that scene.

BRIEF DESCRIPTION OF THE DRAWINGS

An embodiment of the invention will now be described, by way of example only, and with reference to the accompanying drawings, in which.

DETAILED DESCRIPTION OF EXEMPLARY EMBODIMENTS

Figure 1:
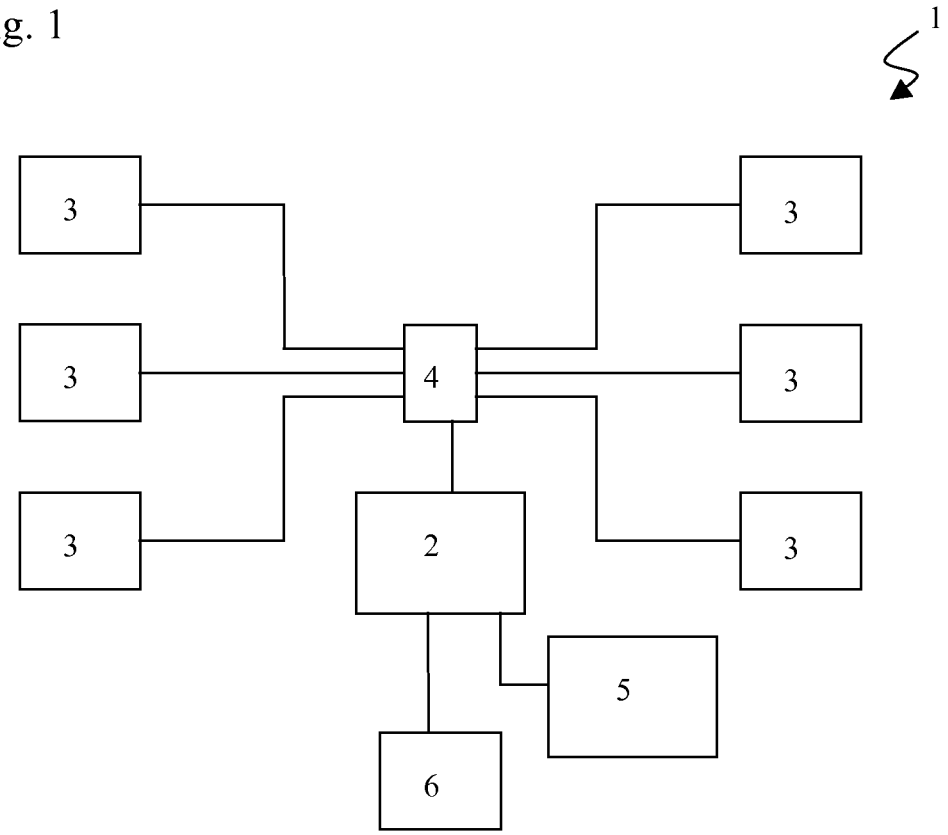
FIG. 1 is a block diagram showing a first embodiment of the invention.

FIG. 1 shows a first lighting control system 1 according to the invention. The lighting control system 1 comprises a first control unit 2, which in turn controls six lights 3. The first control unit 2 comprises six dimmers, each of which is used to control the power supplied to a light 3. A power usage monitor 4 measures the current consumed by the lights, from which the power consumption can be calculated. The first lighting control system 1 also comprises an LCD display 5 and a network connection 6, for the user to control the system. The network connection 6 comprises an RS-232 gateway.

Figure 2:
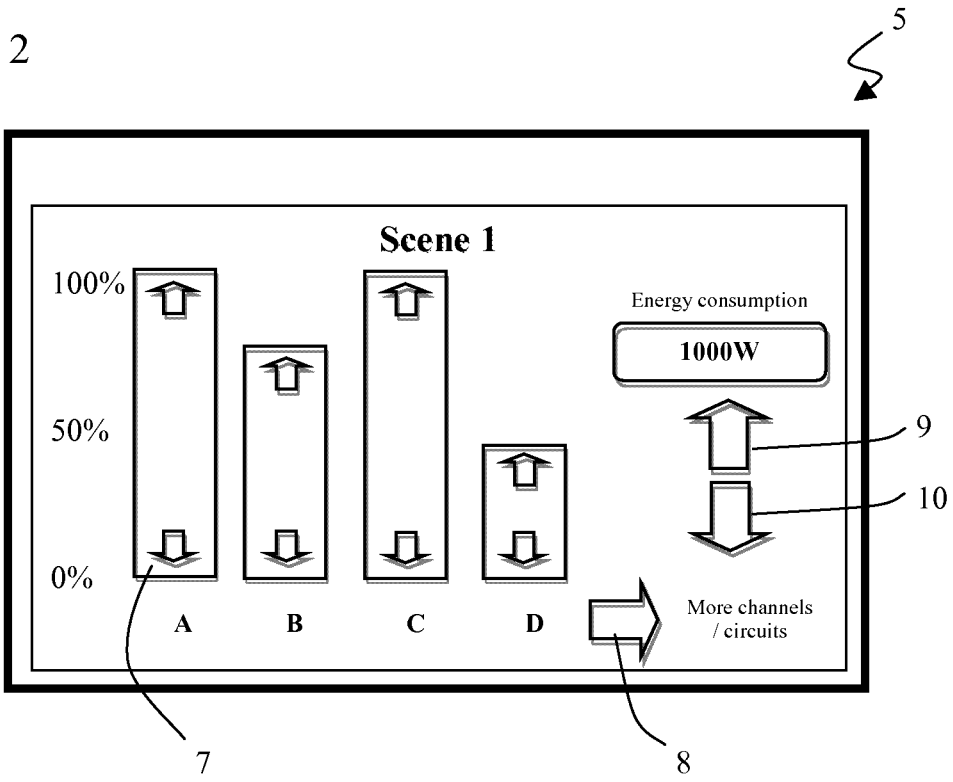
FIG. 2 shows an LCD display according to the first embodiment.

FIG. 2 shows the LCD display 5 in operation. The LCD display 5 is a touch-screen display, so that the user can control the first lighting control system 1 by interacting directly with the LCD display 5. The first lighting control system 1 is capable of storing and recalling a number of pre-programmed scenes, each of which comprises lighting levels for the six lights 3. The user can select between these scenes to suit their requirements by pressing the LCD display 5 at the top, where the scene number is displayed.

The LCD display 5 includes a display of the current power consumption, labelled energy consumption on the LCD display 5 in FIG. 2 as this will tend to be more clearly understood by users.

Once a scene has been selected, the user can then adjust the lighting level of each light 3 to suit their specific needs. For example, if the user is working at a desk, they may wish to increase the light directly above that desk. In FIG. 2, the control bars 7 for four of the lights 3 are visible, and the lighting levels can be adjusted by pressing the arrows provided on the control bars 7. Pressing the "More channels/circuits" arrow 8 on the bottom right hand corner of the display would bring up controls for the remaining two lights 3, so that the user can adjust them.

If the user increases the lighting level of a first light 3, then the first control unit 2 will reduce the lighting level of the remaining lights 3 so that the total power used by the lighting control system 1 as measured by the power usage monitor 4 remains the fixed.

Similarly, if the user decreases the lighting level of a first light 3, then the first control unit 2 will increase the lighting level of the remaining lights 3 so that the total power used remains fixed.

The user can also adjust the power consumption of the lighting control system 1 by tapping the arrows 9, 10 displayed under the energy consumption on the LCD display 5. This will cause all of the lights to brighten or dim so as to use more or less power as required. The percentage difference in lighting level between each light 3, as displayed on the LCD display 5, is maintained as the power consumption is adjusted, until a given light reaches 100% or 0%.

The lighting level of any given light 3 can be fixed, so that it will not change when the power consumption is adjusted, by tapping the centre of the relevant control bar 7.

The first lighting control system 1 can also be controlled using a computer through the network connection 6, which comprises an Ethernet port. The user then controls the lights using an application on their computer which is similar to the LCD display 5. The first lighting control system can be controlled via the network connection 6 using any device suitable for use with a RS-232 gateway. For example, AV (audio visual) control units can be used to control the lights, including motorised units. The first lighting control system can also be controlled via relay outputs connected to a volt-free input unit.

Figure 3:
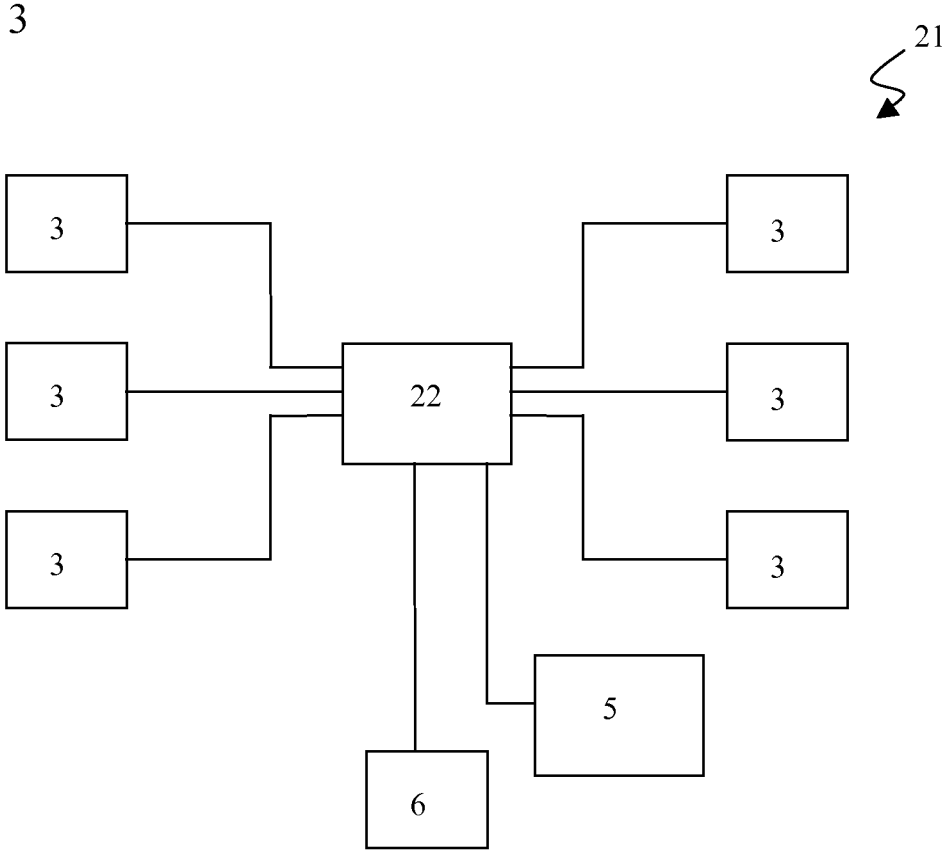
FIG. 3 is a block diagram showing a second embodiment of the invention.

FIG. 3 shows a second lighting control system 21 which comprises a second control unit 22, six lights 3, and LCD display 5 and a network connection 6. In use, the second lighting control system 21 functions in the same way as the first lighting control system 21 except that the power consumption of the six lights 3 is not directly measured. Instead, when the second lighting control system 21 is installed or substantially altered, the electrical load is measured for various lighting levels and recorded by the second control unit 22. The second control unit 22 then calculates power usage from then on by comparing the current lighting levels to the known power usage characteristics of the lights. The second control unit 22 therefore fulfils the role of a power usage monitor.

The second lighting control system 22 has the advantage of being cheaper and easier to maintain than the first lighting control system, as it requires fewer components. However, the power usage measurements are typically less reliable and installation is more complicated than for the first lighting control system 21.

Each light 3 in either of the embodiments of the invention may be a single light source, such as an incandescent bulb, or it may be a plurality of light sources, such as a collection of halogen bulbs either in a single unit or distributed more widely around the area to be lit.

Alternatively, or in addition to the LCD display 5 and network connection 6, the first and second lighting control systems 22, 23 can be controlled using a plate which comprises several switches or dials. Such a plate will typically be supplied for use in the event that the LCD display 5 malfunctions.

The six dimmers in the first control unit 2 or the second control unit 22 are typically mains-voltage phase cutting dimmers designed to work with tungsten loads in incandescent bulbs. However, other dimming systems can be used. For example, the dimmers could be traditional resistive dimmers. Also, in some embodiments the control unit 2, 22 may be arranged to send out a signal to a further controller either located within the lights 3 or intermediate between the control unit and the lights. For example, the control unit 2, 22 may send signals to a further controller incorporated into a fluorescent ballast or to an intermediate LED controller. In the case of a fluorescent ballast, the signal sent will typically be the digital DSI or DALI, or an analogue 1-10V control. An LED controller will typically use the DMX protocol.

A last embodiment of the invention is intended for use with decentralised lighting control systems, systems that distribute the processing around all the system devices that are on the same communication bus. A decentralised system has devices, which may be dimmers, fluorescent ballast controllers, RS232 interfaces, switch plates or LCD user interfaces as described above, that are all connected to the same communication bus. If a user presses a button on a switch plate that is programmed to select Scene 1, for example, a Scene 1 message is sent round all devices on the bus. Only those devices that have outputs (circuits) that are in Scene 1 will respond by going to the programmed level, ie circuit 3 may have been programmed to go to 70% brightness when Scene 1 is selected.

The invention claimed is:

1. A lighting control system comprising:

a plurality of lights;

a control unit; and a power usage monitor suitable for monitoring the power used by the lights, wherein, in use, when the user varies the lighting level of a first light, the control unit is configured to maintain the required lighting level of the first light, whilst varying the lighting level of at least a second light to maintain a pre-selected total power usage level.

2. A lighting control system as claimed in claim 1, wherein, in a first mode of operation, when the user increases the lighting level of a first light, the control unit is configured to decrease the lighting level of at least a second light such that the total power usage remains beneath a predetermined maximum.

3. A lighting control system as claimed in claim 1, wherein the lighting control system further comprises at least one dimmer, arranged so as to control the power supply to at least one light.

4. A lighting control system as claimed in claim 1, wherein the power usage monitor comprises a power meter for measuring the wattage consumed by the lights.

5. A lighting control system as claimed in claim 1, wherein the power usage monitor comprises a unit that calculates power consumption based on the current lighting level and the known characteristics of the lighting control system.

6. A lighting control system as claimed in claim 1, wherein, in a second mode of operation, when the user decreases the lighting level of a first light, the control unit is configured to increase the lighting level of at least a second light such that the total power usage remains above a predetermined minimum.

7. A lighting control system as claimed in claim 1, wherein, in a third mode of operation, there are no predetermined levels of power usage.

8. A lighting control system as claimed in claim 1, wherein, in a fourth mode of operation, when the user changes the lighting level of a first light, the control unit is configured to change the lighting level of at least a second light such that the total power usage remains within a predetermined range.

9. A lighting control system as claimed in claim 1, wherein the user is able to adjust the power consumed by the lighting control system centrally, the control unit being configured to change the lighting level of the lights such that the total power usage is that determined by the user.

10. A lighting control system as claimed in claim 1, wherein the control unit is configured to store a plurality of scenes, each scene comprising the lighting levels of the plurality of lights, and reproduce a scene in response to actions from the user.

11. A lighting control system as claimed in claim 10, wherein each scene is associated with a predetermined maximum power usage.

* * * * *